US005440314A

United States Patent [19]

Tabourier

[11] Patent Number: 5,440,314

[45] Date of Patent: Aug. 8, 1995

[54] DEVICE TO STABILIZE THE BEAM OF AN ELECTRONIC SCANNING ANTENNA RIGIDLY FIXED TO A MOVING BODY

[75] Inventor: Rémy Tabourier, L'Hay les roses, France

[73] Assignee: Thomson-CSF, Paris, France

[21] Appl. No.: 178,657

[22] Filed: Jan. 7, 1994

[30] Foreign Application Priority Data

Jan. 15, 1993 [FR] France ..... 93 00352

[51] Int. Cl.[6] ..... H01Q 3/22

[52] U.S. Cl. ..... 342/371; 244/3.15

[58] Field of Search ..... 244/3.15; 342/371

[56] References Cited

U.S. PATENT DOCUMENTS

| | | | |
|---|---|---|---|
| 3,810,177 | 5/1974 | Tabourier . | |
| 4,100,545 | 7/1978 | Tabourier . | |
| 4,382,258 | 5/1983 | Tabourier . | |
| 4,590,445 | 5/1986 | Tabourier et al. . | |
| 4,765,573 | 8/1988 | Wells | 244/3.15 |
| 4,830,311 | 5/1989 | Pritchard et al. | 244/3.15 |
| 4,907,000 | 3/1990 | Tabourier . | |
| 5,020,126 | 5/1991 | Tabourier . | |
| 5,052,637 | 11/1991 | Lipps . | |

FOREIGN PATENT DOCUMENTS 0107232 5/1984 European Pat. Off. .

OTHER PUBLICATIONS

Michael K. Masten, et al., Proceedings of the 1987 American Control Conference, Jun. 10–12, 1987, pp. 1477–1482, "Line-of-Sight Stabilization/Tracking Systems: An Overview."

Michael R. James, et al., 1985 IEEE Military Communications Conference, Oct. 20–23, 1985, pp. 300–305, "Adaptive Alignment of a Shipboard Satellite Terminal."

*Primary Examiner*—Mark Hellner

*Attorney, Agent, or Firm*—Oblon, Spivak, McClelland, Maier & Neustadt

[57] ABSTRACT

The disclosed circuit decouples the aiming of an electronic scanning antenna from the motions of its platform which is assumed to be a moving body. It has two independent tracking channels which determine the direction cosines of the beam along pitch and yaw axes of a referential trihedron that is related to the platform and that has its roll axis colinear with the direction of orientation of the antenna. Each of these channels is decoupled from the motions of the platform by the introduction of a variable that is deduced, by a stabilization circuit, from the gyrometrical measurements of an inertial unit linked to the platform. This device makes it easy for the beam of the antenna to carry out a watch scanning operation or target-tracking operation that is independent of the motions of the platform. Should the electronic scanning antenna form part of a homing unit of the missile, it can easily be complemented by a proportional navigation guidance device.

6 Claims, 3 Drawing Sheets

DEVICE TO STABILIZE THE BEAM OF AN ELECTRONIC SCANNING ANTENNA RIGIDLY FIXED TO A MOVING BODY

BACKGROUND OF THE INVENTION

1. Field of the Invention

The present invention relates to the decoupling of the aiming of the beam of an electronic scanning antenna from the motions of the moving body that supports it, whether the aiming of the beam is done by scanning during a watch or by the following of angular deviation measurement signals in target-tracking mode. It also relates to the guidance of a moving body fitted out with an electronic scanning antenna radar in order to track a target followed by means of angular deviation measurement signals delivered by the electronic scanning antenna.

2. Description of the Prior Art

There are known ways of decoupling the aiming of an antenna that is mechanically steerable in elevation and in azimuth from the motion of its supporting platform. A standard way of achieving this consists in equipping the antenna with gyroscopic mechanisms which, through a servocontrol system, prevent it from following the rotational motions of its support. However, mechanisms such as these are bulky and cumbersome, and it is therefore sought to eliminate them.

Another method to decouple the aiming of a mechanically steerable antenna from the motions of its support consists in using the indications given by an inertial unit linked to the support to eliminate the effects of the motion of the support on the aiming of the antenna by means of two servocontrol systems controlling the elevation and azimuth angles of aim of the antennas. It is then necessary, by means of trigonometrical relationships, to express the components of the inherent speed of rotation of the support given by the inertial unit with respect to a frame of reference or referential frame related to the support, in terms of variations of elevation and azimuth angles.

It has been proposed, notably by the U.S. patent application No. 5,052,637, to apply the latter decoupling method to electronic scanning antennas even though they are rigidly fixed to their support and even though the elevation and azimuth angles are not the variables used in electronic aiming. This results in complications in the computations that could lead to harmful couplings.

SUMMARY OF THE INVENTION

The present invention is aimed at a decoupling, that is simple to implement and reliable, of the aiming of the beam of an electronic scanning antenna from the motions of its platform.

An object of the invention is a device to stabilize the aiming of the beam of an electronic scanning antenna that is rigidly fixed to a moving body, equipped with a pointer that operates on the basis of an orientation command constituted by direction cosines v and w of the direction of the beam of the antenna along pitch and yaw axes of a direct orthogonal frame of reference related to the moving body, the roll axis of which is colinear with the direction of orientation of the antenna, said antenna being controlled by a control circuit for the deflection of the beam delivering components, along the pitch and yaw axes of the frame of reference related to the moving body, of an instructed value of modification of deflection of the beam that is independent of the rotational speed of the moving body, said moving body being equipped with an inertial unit giving the components p, q and r of its inherent speed of rotation, along the roll, pitch and yaw axes of the frame of reference related to the moving body. This stabilization device comprises:

a determining circuit that determines the direction cosine u, along the roll axis of the frame of reference related to the moving body, of the direction of the beam on the basis of the other two direction cosines v and w, along the pitch and yaw axes of the frame of reference related to the moving body, of the direction of the beam that are applied to the pointer, by the implementation of the relationship:

$$u = \sqrt{1 - v^2 - w^2}$$

a stabilization circuit receiving the components p, q, r of the inherent speed of rotation of the moving body delivered by the inertial unit, the direction cosines v and w applied to the pointer and the direction cosine u generated by the determining circuit, and delivering a first component of stabilization pw-ru along the pitch axis of the frame of reference related to the moving body and a second component of stabilization qu-pv along the yaw axis of the frame of reference related to the moving body;

a first summing integrator circuit adding and integrating the component, with reference to time, along the pitch axis of the frame of reference related to the moving body, of the instructed value of modification of deflection delivered by the deflection control circuit, and the first component of stabilization, along the pitch axis of the frame of reference related to the moving body, delivered by the stabilization circuit to obtain the direction cosine v, along the pitch axis of the frame of reference related to the moving body, of the direction of the beam, and a second summing integrator circuit adding and integrating the component, with reference to time, along the yaw axis of the frame of reference related to the moving body, of the instructed value of modification of deflection delivered by the deflection control circuit, and the second component of stabilization, along the yaw axis of the frame of reference related to the moving body, delivered by the stabilization circuit to obtain the direction cosine w, along the yaw axis of the frame of reference related to the moving body, of the direction of the beam.

The circuit to control the deflection of the beam may be a scanning control circuit giving the components, along the pitch and yaw axes of the frame of reference related to the moving body, of an instructed value of scanning speed that is independent of the rotational speed of the moving body. It may also be an angular deviation measurement circuit associated with the electronic scanning antenna and delivering errors on the direction cosines v, w of the direction of the beam with respect to those of the direction of a tracked target.

An object of the invention is also a device for guidance by proportional navigation implementing the above-mentioned beam stabilization device.

BRIEF DESCRIPTION OF THE DRAWINGS

Other features and advantages of the invention will emerge from the following description of several embodiments given by way of examples. This description will be made with reference to the drawings, of which.

MORE DETAILED DESCRIPTION

Figure 1:
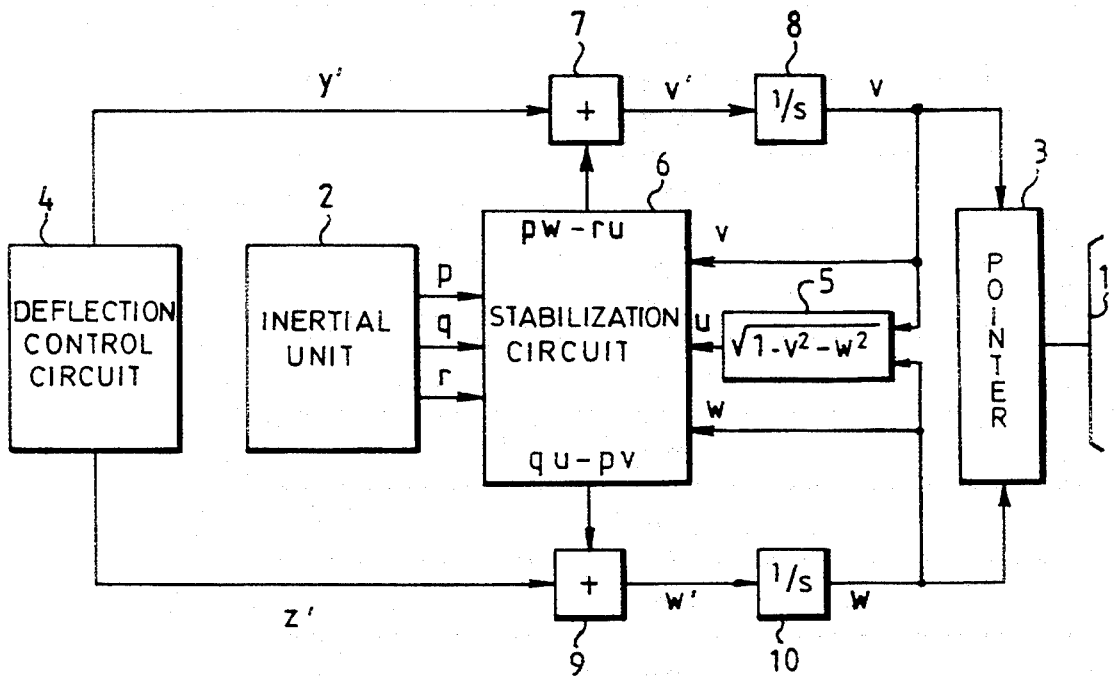
FIG. 1 shows the diagram of a device for the stabilization of the aiming of an electronic scanning antenna with respect to the motions of the support of the antenna making it possible to carry out a scanning of the beam decoupled from the motions of the antenna support.

In order to decouple the command for the orientation of the beam of an antenna from the rotational motions of the moving body to which it is fixed, it should be possible to give commands to the beam of the antenna to make it rotate according an inertial, orthogonal, referential trihedron in translation related to the moving body in order to get these commands carried out by the antenna aiming circuit.

To do this, use is made of the standard vector relationship between the derivative dU/dt with respect to time in the inertial frame of reference of the unit vector U of the direction of aim of the antenna beam, the derivative δU/δt with respect to time in the frame of reference related to the moving body and to the antenna of this same unit vector U and the vector product of, on the one hand, the instantaneous rotation vector ω of the moving body and of the antenna with respect to the inertial frame of reference and, on the other hand, the unit vector U:

$$\frac{dU}{dt} = \frac{\delta U}{\delta t} + \omega \wedge U \tag{1}$$

which expresses the fact that the absolute speed of the end of the unit vector U in the inertial frame of reference related to the moving body in translation is equal to the relative speed of the end of this unit vector U in the frame of reference related to the moving body and to the antenna plus the speed of the rotational driving of the moving body.

This vector relationship is then expressed in the frame of reference related to the moving body which is assumed, according to the usually adopted conventions, to be direct and to have an axis $Ox_a$ corresponding to the main axis of aim of the antenna with respect to which the roll motions occur, an axis $Oy_a$ in the plane of the antenna with respect to which the pitch motions occur and an axis $Oz_a$ in the plane of the antenna with respect to which the yaw motions occur.

In this frame of reference related to the moving body, the unit vector U has, as its components, the direction cosines u, v, w which are used by the pointer of the antenna to orient its beam:

$$[U]=[u,v,w]^T$$

the instantaneous rotation vector ω, the roll component p, pitch component q and yaw component r of the moving body delivered by an inertial unit that is fixedly joined to this moving body:

$$[\omega]=[p,q,r]^T$$

the derivative vector dU/dt with respect to time in the inertial frame of reference, the components x', y', z' defining the rotational speed, in the inertial frame of reference, imposed on the antenna beam by an orientation command decoupled from the rotational motions of the moving body $$\left[\frac{dU}{dt}\right] = [x',y',z']^T$$

and the derivative vector δU/δt with respect to time in the related frame of reference, the components u', v', w' defining the rotation speed in the related frame of reference, imposed on the antenna beam by the orientation command $$\left[\frac{\delta U}{\delta t}\right] = [u',v',w']^T$$

It is observed that:

$$u^2+v^2+w^2=1 \tag{2}$$

since u, v, w are the direction cosines defining, in the related frame of reference, the unit vector U of the direction of orientation of the beam of the antenna.

We also have, owing to the definition of the derivative vector δU/δt:

$$u' = \frac{du}{dt}, \; v' = \frac{dv}{dt} \; etw' = \frac{dw}{dt} \tag{3}$$

There also exist two other relationships that will be useful here below:

$$uu'+vv'+ww'=0 \tag{4}$$

$$ux'+vy'+wz'=0 \tag{5}$$

The first relationship (4) results from a derivation, with respect to time, of the relationship (2) and can also be written:

$$U\frac{\delta U}{\delta t} = 0 \tag{6}$$

The second relationship (5) flows from the expression of the scalar product UdU/dt by means of the relationship (1):

$$U \cdot \frac{dU}{dt} = U \cdot \frac{\delta U}{\delta t} + U \cdot (\omega \wedge U) \tag{7}$$

taking account of the fact that the term $U\delta U/\delta t$ is zero owing to the relationship (6) as is the combined product $U.(\omega \wedge U)$ which comprises twice the same vector.

By expressing the vectors of the relationship (1) on the basis of their components in the frame of reference related to the moving body, the following matrix relationship is then obtained:

$$\left[\frac{dU}{dt}\right]=\begin{bmatrix} x' \\ y' \\ z' \end{bmatrix}=\begin{bmatrix} u'+qw-rw \\ v'+ru-pw \\ w'+pv-qu \end{bmatrix} \quad (8)$$

which gives a system of three equations that can be used to express the direction cosines u, v, w, in the frame of reference related to the moving body, of the direction of aim of the beam and their derivatives in time u', v', w' as a function of a speed of rotation with respect to the inertial reference frame of components x', y', z' in the frame of reference related to the moving body, dictated by an orientation command decoupled from the rotational motions of the moving body and of the antenna.

The first equation of the system is superfluous since it is assumed that the antenna beam is always pointed towards the front of the moving body, i.e. that the direction cosine u is always positive, and that there is the relationship between the direction cosines:

$$u^2+v^2+w^2=1$$

Hence, to ensure the decoupling of the direction of orientation of the antenna beam, only the last two equations associated with the following relationship are implemented:

$$u=\sqrt{1-v^2-w^2}$$

FIG. 1 shows an exemplary view of an implementation such as this to carry out a scanning of the beam of an electron scanning antenna decoupled from the rotational motions of the moving body that supports it.

This FIG. 1 shows an electronic scanning antenna 1 fixed to a moving body equipped with an inertial unit 2 that delivers three components, namely a roll component p, a pitch component q and a yaw component r of the rotational motion of the moving body with respect to an inertial frame of reference following it in translation in a related frame of reference having a roll axis $Ox_a$ corresponding to the axis of orientation of the antenna and pitch axis $Oy_a$ and yaw axis $Oz_a$ in the plane of the antenna.

The antenna 1 is provided with an aiming computer 3 working on the basis of direction cosines v and w along the axes of pitch and yaw of the related frame of reference while a device 4 for controlling the deflection of the antenna beam delivers the components y' and z', along the pitch and yaw axes of the related frame of reference, of an instructed value of modification of deflection of the beam of the antenna with respect to the inertial reference system.

The direction cosines v and w applied to the aiming computer 3 are also applied to the determining circuit 5 which determines the third direction cosine u of the direction of the beam of the antenna with respect to the related reference system by the implementation of the following relationship:

$$u=\sqrt{1-v^2-w^2}$$

The components p, q, r, in the related frame of reference, of the rotational speed of the moving body with reference to the inertial reference system delivered by the inertial unit 2, are applied, along with the direction cosines v, w arriving at the aiming computer 3 and the direction cosine u generated by the determining circuit 5, to a stabilization circuit 6 which computes the components pw-ru and qu-pv.

The component pw-ru delivered by the stabilization circuit 6 is added by a summing circuit 7 to the pitch component y' of the instructed value of modification of deflection of the antenna beam with respect to the inertial frame of reference delivered by the deflection control device 4. This summing operation makes it possible to obtain the derivative v' of the direction cosine v along the pitch axis:

$$v'=y'+pw-ru$$

which is integrated by an integrator 8 to obtain the direction cosine v, along the pitch axis, of the direction of the beam designed for the aiming computer 3, for the determining circuit 5 and the stabilization circuit 6.

The component qu-pv delivered by the stabilization circuit 6 is added by a summing circuit 9 to the yaw component z' of the instructed value of modification of deflection of the antenna beam with respect to the inertial frame of reference delivered by the deflection control device 4. This summing operation makes it possible to obtain the derivative w' of the direction cosine w along the yaw axis:

$$w'=z'+qu-pv$$

which is integrated by an integrator 10 to obtain the direction cosine w, along the yaw axis, of the direction of the beam designed for the aiming computer 3, for the determining circuit 5 and the stabilization circuit 6.

Figure 2:
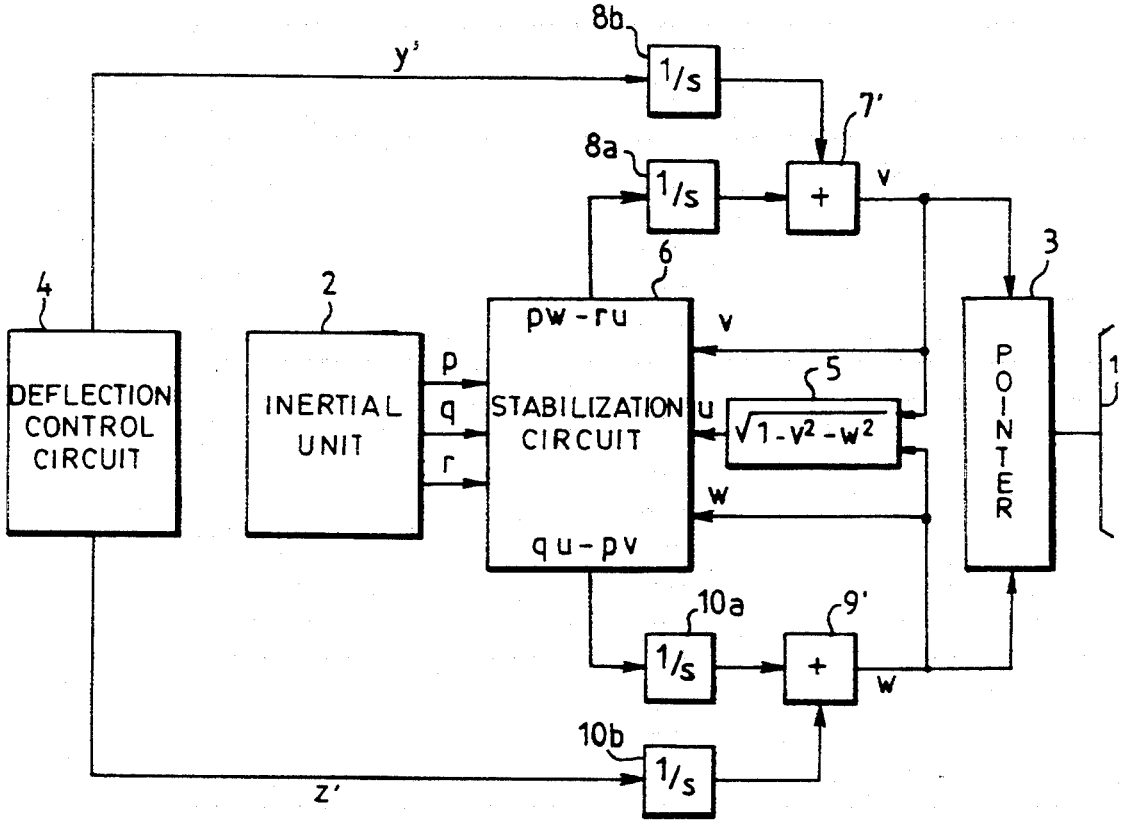
FIG. 2 shows the diagram of a variant of the stabilization device of FIG. 1.

As a variant, instead of having integrators 8, 10 available downline with respect to the summing circuits 7, 9, it is possible to duplicate them at 8*a*, 8*b* and 10*a*, 10*b* and to place them, as shown in FIG. 2, upline with respect to the summing circuits reindexed 7' and 9'.

The deflection control circuit 4 may be a scanning control circuit which delivers, as components y', z' along the pitch and yaw axes of the instructed value of modification of deflection, the components along the pitch and yaw axes of a desired speed of rotation of the antenna beam that is independent of the motion of the moving body. There is then obtained a scanning of the horizon by the antenna beam decoupled from the motions of the moving body that may be useful during a watch period.

Instead of seeking a scanning motion for the antenna beam, it may be desired to carry out a target tracking operation by angular deviation measurement. It suffices then to use an angular deviation measurement circuit as a deflection control circuit 4. It is shown indeed that an angular deviation measurement circuit associated with an electronic scanning antenna directly delivers the errors $\Delta v$ and $\Delta w$ existing along the pitch and yaw axes, between the direction cosines of the direction of the beam and those of the tracked target.

To be sure of this, we may consider the constitution of an electronic scanning antenna. This is formed by a number of radiating cells $C_i$ distributed in a plane that is referenced by the pitch axis $Oy_a$ and yaw axis $Oz_a$ of the related frame of reference according to the coordinates $(Y_i, Z_i)$ so that said pitch axis $Oy_a$ and yaw axis $Oz_a$ are axes of symmetry. The radiation of the antenna in the direction of the unit vector U having direction cosines u, v, w with respect to the related reference system is obtained by assigning, to each radiating cell Ci a phase:

$$\psi_i = -2\pi(vy_i + wz_i)/\lambda$$

λ being the wavelength sent out or received. The field received from one unit direction U':

$$[U'] = [u+\Delta u, v+\Delta v, w+\Delta w]^T$$

is then, for a radiating cell $C_i$ and after phase-shift by this cell:

$$a_i \exp[2\pi j(\Delta v_i y_i + \Delta w_i z_i)/\lambda]$$

$a_i$ being a weighting coefficient with which the signal of the radiating cell $C_i$ is added to the signals of the other radiating cells to generate the total signal of the antenna.

Assuming that the errors Δv and Δw are small, i.e. that the offset of the beam with respect to the target is small, the field received by a radiating cell $C_i$ can be written as follows:

$$a_i[1 + 2\pi j(\Delta v y_i + \Delta w z_i)/\lambda]$$

so that the total signal of the antenna is equal to:

$$\Sigma a_i + 2\pi j\Delta v/\lambda \Sigma a_i y_i + 2\pi j\Delta w/\lambda \Sigma a_i z_i$$

The values adopted for the weighting coefficient $a_i$ are different depending on whether it is sought to achieve a sum channel, a circular angular deviation measurement difference channel or an elevation angular deviation measurement difference channel.

To achieve a sum channel, the weighting coefficients $a_i$ are chosen such that we have:

$$\Sigma a_i y_i = \Sigma a_i z_i = 0$$

This can be done by giving identical values to the weighting coefficients of two radiating cells positioned in the antenna symmetrically with respect to the pitch axis $Oy_a$ and yaw axis $Oz_a$. There is then obtained an overall level of signal:

$$\Sigma a_i$$

independent of the aiming errors Δv, Δw so long as these are low.

To obtain a circular angular difference measurement channel, weighting coefficients $a_i$ are chosen such that:

$$\Sigma a_i = \Sigma a_i z_i = 0$$

This can be done by giving identical values to the weighting coefficients of two radiating cells positioned in the antenna symmetrically with respect to the pitch axis $Oy_a$ and by giving opposite values to the weighting coefficients of two radiating cells positioned in the antenna symmetrically with respect to the yaw axis $Oz_a$. There is then obtained an overall level of signal:

$$2\pi j/\lambda(\Sigma a_i y_i)\Delta v$$

which is proportional to the error Δv.

To obtain an elevation angular deviation measurement signal, the weighting coefficients $a_i$ are chosen such that:

$$\Sigma a_i = \Sigma a_i y_i = 0$$

This can be done by giving opposite values to the weighting coefficients of two radiating cells positioned in the antenna symmetrically with respect to the pitch axis $Oy_a$ and by giving identical values to the weighting coefficients of two radiating cells positioned in the antenna symmetrically with respect to the yaw axis $Oz_a$. There is then obtained an overall level of signal:

$$2\pi j/\lambda(\Sigma a_i z_i)\Delta w$$

which is proportional to the error Δw.

The angular deviation measurement device of an electronic scanning antenna therefore gives two aiming error signals, one proportional to an error Δv on the direction cosine v, along an pitch axis, of the direction of aim of the beam, and the other proportional to an error Δw on the direction cosine w, along the yaw axis, of the direction of aim of the beam.

Figure 3:
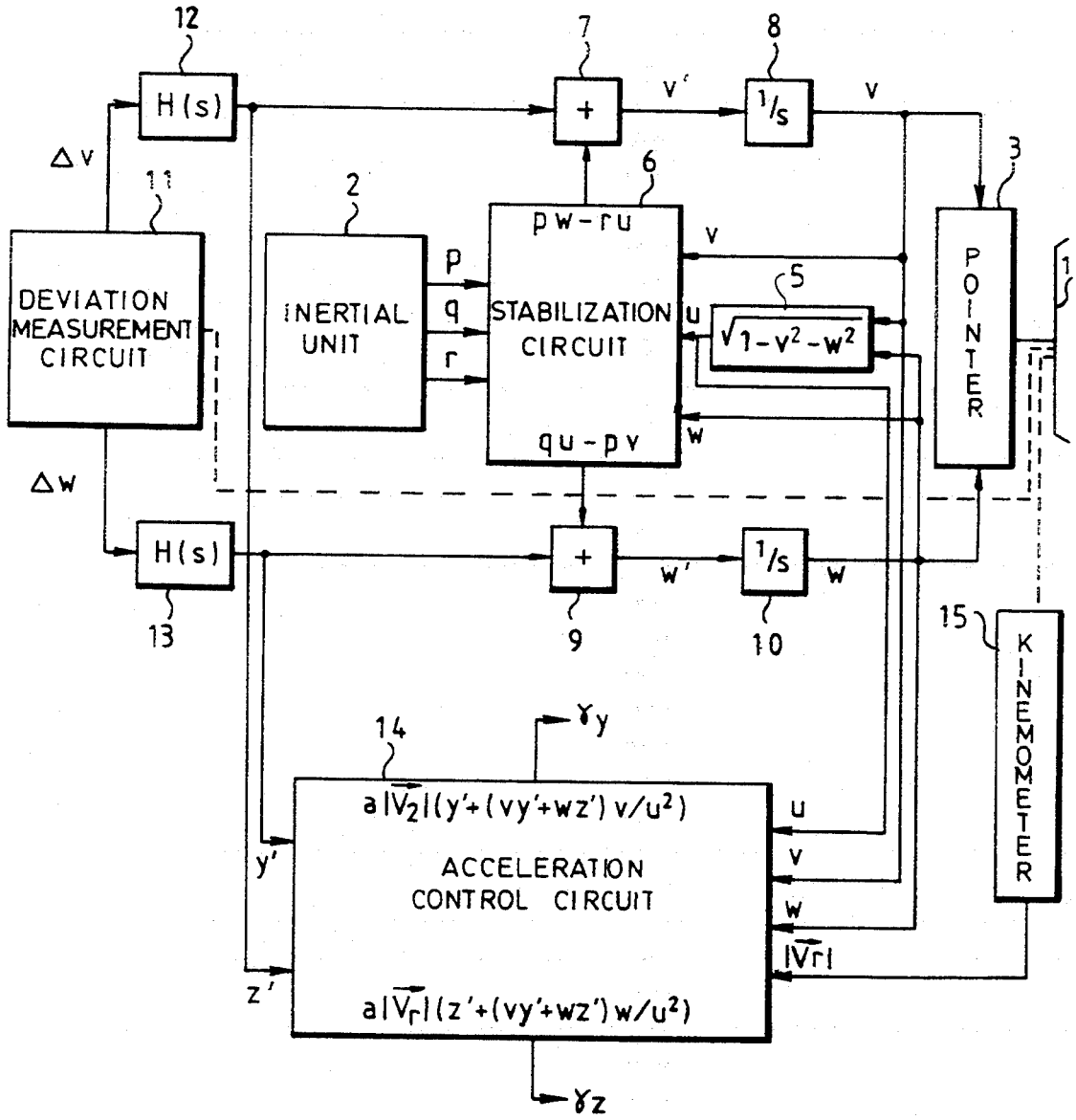
FIG. 3 shows the diagram of a device for the guidance of moving bodies by proportional navigation incorporating a device for the stabilization of the aiming of the beam of an electronic scanning antenna fixed to the moving body and used for a target tracking operation.

To obtain a target-tracking device, therefore, it is possible, instead of the deflection control circuit 4, to use an angular deviation measurement circuit 11 as shown in FIG. 3. This angular deviation measurement circuit 11, whose coupling to the electronic scanning antenna 1 is indicated by a line of dashes, gives a component of an instructed value of modification of deflection along the pitch axis that is a component proportional to the error Δv on the direction cosine v of the direction of aim of the beam and gives a component of an instructed value of modification of deflection along the yaw axis that is a component proportional to the error Δw on the direction cosine w of the direction of aim of the beam. These two instructed values are applied to two tracking operations that are independent and have no mutual coupling.

As in all tracking systems, loop filters 12, 13 are positioned on the path of the components Δv, Δw. The transfer characteristic of these loop filters, which is of the low-pass type, is conventionally called H(s).

A variant of this scheme makes use of all the modern filtering methods, notably the Kalman filtering method, which comprises an explicit estimation of the angular speed. In this case, H(s) must be replaced by the estimator which delivers y' or z' on the basis of the aiming error Δy or Δz.

The target-tracking device using the beam of an electronic scanning antenna borne by a moving body according to FIG. 2 can be supplemented so as to serve as a guidance device using proportional navigation that tends to enable the moving body to catch up with the target to which the beam of its electronic scanning antenna is aimed, for the following are available:

firstly, direction cosines of the line of sight which are the direction cosines of the direction of aim of the beam and, secondly, variations in time y', z' of the rotation of this line of sight with respect to the inertial reference along the pitch and yaw axes of the frame of reference related to the moving body.

Figure 4:
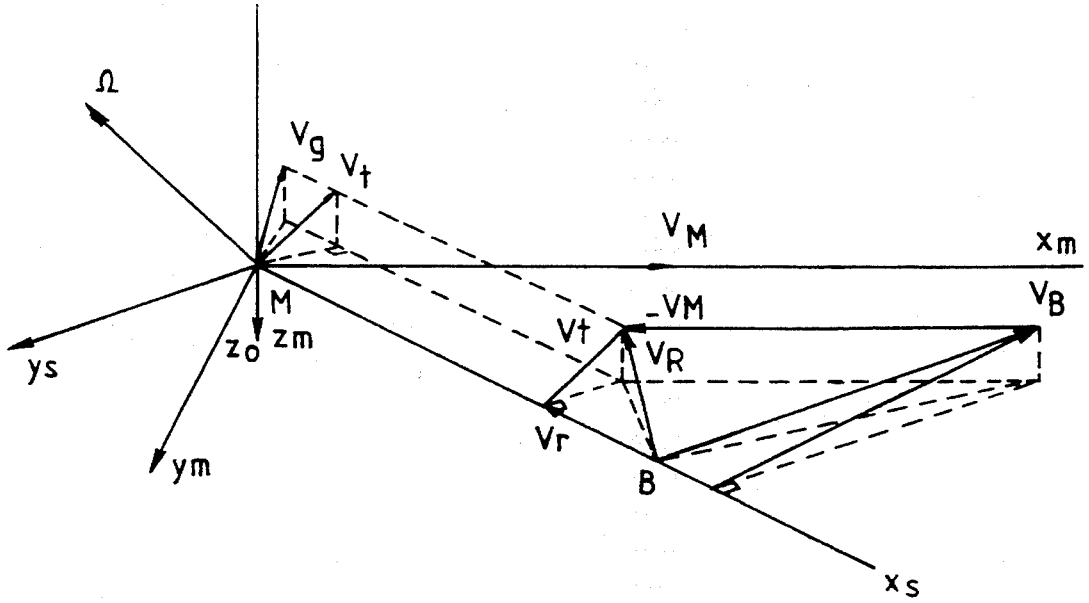
FIG. 4 shows a vector diagram illustrating the principle of proportional navigation.

FIG. 4 is a vector diagram illustrating the principle of proportional navigation. The figure shows a moving body M moving at a speed $V_M$ approaching a target B moving at a speed $V_B$. In this figure, axes $Mx_m y_m z_m$ constitute a direct orthogonal trihedron related to the moving body M referencing, by the plane $My_m z_m$, the plane of the rudder units of the moving body. The axis $Mx_m$ is a roll axis colinear with the speed vector $V_M$ of the moving body. The axis $Mz_m$ is a yaw axis perpendicular to the line of sight joining the moving body M to the target B. Axes $Mx_s$, $y_s$, $z_z$ constitute another direct orthogonal trihedron related to the moving body with an axis $Mx_s$, colinear to the line of sight MB, and an axis $Mz_s$ merged with the axis $Mz_m$.

The relative speed of the target with respect to the moving body, which is expressed by the vector relationship:

$$V_R = V_B - V_M$$

can be split up in two different ways:

either according to a component $V_t$ in the plane $My_s z_s$ perpendicular to the line of sight which is a transversal component and according to a component $V_r$ along the line of sight which is a component of radial speed:

$$V_R = V_t + V_r \quad V_t \text{ and } V_r \text{ orthogonal}$$

or according to a component $V_g$ in the plane $My_m z_m$ of the rudder units resulting from a projection parallel to the line of sight and according to a component $V_l$ not shown in the figure:

$$V_R = V_g + V_l \quad V_g \text{ and } V_l \text{ non-orthogonal}$$

Let Us be the unit vector of the line of sight and r the length MB. The rotation vector Ω of the line of sight is equal, by definition, to:

$$\Omega = Us \wedge Vr/r = Us \wedge Vt/r = Us \wedge Vg/r$$

The principle of proportional navigation consists in seeking to obtain a situation where the line of sight is finally constant. This can be obtained by applying a lateral acceleration to the moving body.

$$\gamma = A\Omega \wedge V_M$$

A being a constant, we get:

$$\gamma = A(U_s \wedge V_g) \wedge V_M/r$$

The formula of the double vector product gives:

$$\gamma = A[(U_s \cdot V_M)V_g - (V_g \cdot V_M)U_s]/r$$

that is $$\gamma = A(U_s \cdot V_M)V_g/r$$

in taking account of the fact that $$V_g \cdot V_M = 0$$

by construction

γ is therefore colinear with $V_g$ which it tends to cancel, which tends to cancel also $V_t$ and justifies the law of navigation.

In the vector relationship (15), there appears a term A ($U_S \cdot V_M$) that is also found in the expression of the reduced gain:

$$a = A(U \cdot V_M)/|\vec{V}_R| \quad (|\vec{V}_R| \text{ being the norm of } V_R)$$

that those skilled in the art generally seek to keep constant for reasons of stability.

In short, to guide a moving body that is tracking a target by proportional navigation, it is necessary to apply the following acceleration to it:

$$\gamma = a|\vec{V}_R|V_g/r$$

It is therefore necessary to estimate $V_g$. This can be done by means of the transversal speed $V_t$ which is equal by definition to:

$$V_t = r\frac{dU_s}{dt}$$

The vector $V_g/r$ which is the projection in the plane of the rudder units $My_m z_m$ of the vector $V_t/r$ in parallel to the line of sight may be written:

$$V_g/r = V_t/r - kU_s$$

k being a scalar. Whence:

$$V_g/r = \frac{dU_s}{dt} - kU_s$$

The unit vector $U_s$ of the line of sight corresponds to the unit vector U of the direction of the antenna beam since it illuminates the target and the frame of reference $Mx_s y_s z_s$ is the frame of reference related to the moving body considered here above so that, in this reference, we have:

$$[U_s] = [u,v,w]^T$$

$$\left[\frac{dU_s}{dt}\right] = [x',y',z']^T$$

whence:

$$\begin{aligned}[V_g/r] &= [x',y',z']^T - k\,[u,v,w]^T \\ &= [x' - ku, y' - kv, z' - kw]^T\end{aligned}$$

The first component x′−ku is zero since, by definition, $V_g$ is in the plane of the rudder units $My_m z_m$.

$$x' - ku = 0$$

Whence:

$$[V_g/r] = [0, y' - vx'/u, z' - wx'/u]$$

It being known that, according to the relationship (5), we have:

$$ux' + vy' + wz' = 0$$

x' can be expressed as a function y' and z'. We get:

$$[V_g/r]=[0,y'+(vy'+wz')v/u^2,z'+(vy'+wz')w/u^2]^T$$

which is written in the form of a product of matrices:

$$[V_g/r]=\begin{bmatrix}0 & 0\\ 1+v^2/u^2 & vw/u^2\\ vw/u^2 & 1+w^2/u^2\end{bmatrix}\times\begin{bmatrix}y'\\ z'\end{bmatrix}$$

The guidance commands are deduced therefrom:

$$[\gamma]=\begin{bmatrix}\gamma_y\\ \gamma_z\end{bmatrix}=a|\vec{V_r}|\cdot\begin{bmatrix}0 & 0\\ 1+v^2/u^2 & vw/u^2\\ vw/u^2 & 1+w^2/u^2\end{bmatrix}=\begin{bmatrix}y'\\ z'\end{bmatrix}$$

The components y' and z' with reference to the pitch and yaw axes of the frame of reference related to the moving body, of the derivative with respect to time of the unit vector of the line of sight Us pertaining to an inertial frame of reference, are none other than the inputs of the summing devices 7 and 9 devoted to the tracking terms upline with respect to the integrators that give v and w, the other two inputs receiving the stabilization terms. Hence, with the target tracking device of FIG. 3, all the parameters are available, except for the modulus of the moving body/target approaching speed $V_r$ enabling the preparation, for the moving body, of the instructed values of lateral acceleration $\gamma_y$, $\gamma_z$ in pitch and yaw constituting commands of guidance in proportional navigation.

To make a guidance device, it suffices therefore to add on, to the target-tracking device as shown in FIG. 3, a means 15 to estimate the moving body/target approaching speed and an acceleration control circuit 14.

The means 15 for estimating the moving body/target approaching speed may be a Doppler kinemometer coupled to the electronic scanning antenna or an estimator exploiting the results of a distance-tracking telemetry operation carried out by a homing device with which the moving body is equipped, or any other means of estimation.

The acceleration control circuit 14 receives the signals y' and z', along the axes of pitch and yaw of the moving body, for the correction of the direction of aim of the beam of the electronic scanning antenna delivered by the angular deviation measurement circuit 11 after processing in the loop filters 12, 13, the values of the direction cosines u, v, w, along the axes of roll, pitch and yaw of the moving body, of the direction of aim of the beam of the antenna, and an estimation or a measurement of the moving body/target approaching speed, and computes an instructed value of acceleration in terms of pitch $\gamma_y$ by the implementation of the relationship:

$$[\gamma_y]=a|\vec{V_r}|(y'+(vy'+wz')v/u^2)$$

and an instructed value of acceleration in terms of yaw by the implementation of the relationship:

$$[\gamma_z]=a|\vec{V_r}|(z'+(vy'+wz')w/u^2)$$

these two relationships being deduced from the matrix relationship (16).

In the foregoing description, all the relationships among variables have been written in continuous form. However, this does not exclude the possibility of their being implemented by a digital processing of sampled variables as is the case when microprocessor circuits are used.

What is claimed is:

1. A device to stabilize the aiming of the beam of an electronic scanning antenna that is rigidly fixed to a moving body, equipped with a pointer that operates on the basis of an orientation command constituted by direction cosines v and w of the direction of the beam of the antenna along pitch and yaw axes of a direct orthogonal frame of reference related to the moving body, the roll axis of which is colinear with the direction of orientation of the antenna, said antenna being controlled by a deflection control circuit for the deflection of the beam delivering components, along the pitch and yaw axes of the frame of reference related to the moving body, of an instructed value of modification of deflection of the beam that is independent of the rotational speed of the moving body, said moving body being equipped with an inertial unit giving the components p, q and r of its inherent speed of rotation, along the roll, pitch and yaw axes of the frame of reference related to the moving body, said device to stabilize comprising:

a determining circuit that determines the direction cosine u, along the roll axis of the frame of reference related to the moving body, of the direction of the beam on the basis of the other two direction cosines v and w, along the pitch and yaw axes of the frame of reference related to the moving body, of the direction of the beam that are applied to the pointer, by the implementation of the relationship:

$$\mu=\sqrt{1-v^2-w^2}$$

a stabilization circuit receiving the components p, q, r of the inherent speed of rotation of the moving body delivered by the inertial unit, the direction cosines v and w applied to the pointer and the direction cosine u delivered by the determining circuit, and delivering a first component of stabilization pw-ru along the pitch axis of the frame of reference related to the moving body and a second component of stabilization qu-pv along the yaw axis of the frame of reference related to the moving body;

a first summing integrator circuit adding and integrating a component, with reference to time, along the pitch axis of the frame of reference related to the moving body, of the instructed value of modification of deflection delivered by the deflection control circuit, and the first component of stabilization, along the pitch axis of the frame of reference related to the moving body, delivered by the stabilization circuit to obtain the direction cosine v, along the pitch axis of the frame of reference related to the moving body, of the direction of the beam, and a second summing integrator circuit adding and integrating a component, with reference to time, along the yaw axis of the frame of reference related to the moving body, of the instructed value of modification of deflection delivered by the deflection control circuit, and the second component of stabilization, along the yaw axis of the frame of reference related to the moving body, delivered by the stabilization circuit to obtain the direction cosine w, along the yaw axis of the frame of reference related to the moving body, of the direction of the beam.

2. The device according to claim 1, wherein said deflection control circuit for the deflection of the beam is a scanning control circuit giving the components, along the pitch and yaw axes of the frame of reference related to the moving body, of an instructed value of scanning speed that is independent of the rotational speed of the moving body.

3. The device according to claim 1, wherein said deflection control circuit for the deflection of the beam is an angular deviation measurement circuit associated with the electronic scanning antenna and delivering, on the basis of the signals received by this antenna, errors $\Delta V$, $\Delta W$ between the direction cosines v, w, along the pitch and yaw axes of the frame of reference related to the moving body, of the direction of the beam and the direction cosines of the direction of a tracked target.

4. The device according to claim 3, further comprising loop filters respectively interposed between the outputs of the angular deviation measurement circuit and the inputs of the first and second summing integrator circuits.

5. A device for guidance, by proportional navigation, of a moving body equipped with an electronic scanning antenna oriented along its roll axis, equipped with a pointer that operates on the basis of an orientation command constituted by the direction cosines v and w, along the pitch and yaw axes of the moving body, of the direction of the beam of the antenna and controlled by an angular deviation measurement circuit that is associated with it and delivers the components of error y', z' between the direction cosines v, w, along the pitch and yaw axes of the moving body, of direction of the beam of the antenna and the direction cosines of the direction of a tracked target, said moving body being equipped with an inertial unit giving the components p, q and r of the inherent speed of rotation of the moving body with respect to its roll, pitch and yaw axes, said device for guidance comprising:

a determining circuit that determines the direction cosine u, along the roll axis of the moving body, of the direction of the beam on the basis of the other two direction cosines v and w, along the pitch and yaw axes of the moving body, of the direction of the beam that are applied to the pointer, by the implementation of the relationship:

$$u = \sqrt{1 - v^2 - w^2}$$

a stabilization circuit receiving the components p, q, r of the inherent speed of rotation of the moving body delivered by the inertial unit, the direction cosines v and w applied to the pointer and the direction cosine u delivered by the determining circuit, and delivering a first stabilization component pw-ru along the pitch axis and a second stabilization component qu-pv along the yaw axis of the moving body;

a first summing integrator circuit adding and integrating, in relation to time, the error y' on the direction cosine v, along the pitch axis of the moving body, of the direction of the beam given by the angular deviation measurement circuit and the first stabilization component, along the pitch axis of the moving body, delivered by the stabilization circuit to obtain the direction cosine v, along the pitch axis of the moving body, of the direction of the beam, a second summing integrator circuit adding and integrating, in relation to time, the error z' on the direction cosine w, along the yaw axis of the moving body, of the direction of the beam given by the angular deviation measurement circuit and the second stabilization component, along the yaw axis of the moving body, delivered by the stabilization circuit to obtain the direction cosine w, along the yaw axis of the moving body, of the direction of the beam, a means to estimate the speed of approach between the moving body and the tracked target $|\vec{V}_r|$, and an acceleration control circuit receiving the errors y', z' on the direction cosines v and w, along the pitch and yaw axes of the moving body, of the direction of aim of the beam, that are delivered by the angular deviation measurement circuit, the values of the direction cosines v and w, along the pitch and yaw axes of the moving body, of the direction of the beam, delivered by the first and second summing integrator circuits, the value of the direction cosine u, along the roll axis of the moving body, of the direction of the beam delivered by the determining circuit, and an estimation $|\vec{V}_r|$ of the speed of approach between the moving body and the tracked target delivered by the means to estimate and delivering a first instructed value of acceleration $\gamma_y$ along the pitch axis of the moving body by implementation of the relationship:

$$[\gamma_y] = a|\vec{V}_r|(y' + (vy' + wz')v/u^2)$$

and a second set value of acceleration $\gamma_z$ along the yaw axis of the moving body by implementation of the relationship:

$$[\gamma_z] = a|\vec{V}_r|(z' + (vy' + wz')w/u^2)$$

a being a constant known as a reduced gain constant.

6. The device according to claim 5, further comprising loop filters respectively interposed between the outputs of the angular deviation measurement circuit and the inputs of the first and second summing integrator circuits and of the acceleration control circuit.

* * * * *

UNITED STATES PATENT AND TRADEMARK OFFICE

CERTIFICATE OF CORRECTION

PATENT NO. : 5,440,314

DATED : August 8, 1995

INVENTOR(S) : Remy TABOURIER

It is certified that error appears in the above-indentified patent and that said Letters Patent is hereby corrected as shown below:

On the title page, Item [54], and Column 1, Lines 2-4, the title should read:

--DEVICE TO STABILIZE THE AIMING OF THE BEAM OF AN ELECTRONIC SCANNING ANTENNA RIGIDLY FIXED TO A MOVING BODY--

Signed and Sealed this

Seventeenth Day of October, 1995

*Attest:*

Bruce Lehman

BRUCE LEHMAN

*Attesting Officer*

*Commissioner of Patents and Trademarks*